US009486760B2

(12) United States Patent
Li et al.

(10) Patent No.: US 9,486,760 B2
(45) Date of Patent: Nov. 8, 2016

(54) FLUID MIXING DEVICE

(71) Applicant: China Petrochemical Development Corporation, Taipei (TW)

(72) Inventors: Chien-Hsien Li, Taipei (TW); Mu-Chuan Ho, Taipei (TW); Cheng-Wei Lin, Taipei (TW); Han-Yu Wu, Taipei (TW)

(73) Assignee: China Petrochemical Development Corporation, Taipei (TW)

( * ) Notice: Subject to any disclaimer, the term of this patent is extended or adjusted under 35 U.S.C. 154(b) by 148 days.

(21) Appl. No.: 14/571,554

(22) Filed: Dec. 16, 2014

(65) Prior Publication Data

US 2015/0165404 A1 Jun. 18, 2015

(30) Foreign Application Priority Data

Dec. 16, 2013 (TW) ..... 102223698 U

(51) Int. Cl.

| | |
|---|---|
| ***B01F 5/04*** | (2006.01) |
| ***B01F 15/02*** | (2006.01) |
| ***B01F 5/00*** | (2006.01) |
| ***B01F 5/02*** | (2006.01) |

(52) U.S. Cl.

CPC ..... *B01F 15/0235* (2013.01); *B01F 5/0065* (2013.01); *B01F 5/0268* (2013.01); *B01F 5/0403* (2013.01); *B01F 5/0405* (2013.01); *B01F 5/046* (2013.01); *B01F 5/0451* (2013.01)

(58) Field of Classification Search

CPC ..... B01F 5/0403
USPC ..... 366/175.2, 178.2
See application file for complete search history.

(56) References Cited

U.S. PATENT DOCUMENTS

| | | | | |
|---|---|---|---|---|
| 3,601,318 A | | 8/1971 | Gehring et al. | |
| 4,285,367 A | | 8/1981 | Nommensen | |
| 5,931,579 A | * | 8/1999 | Gallus | B01F 7/00766 366/163.2 |

FOREIGN PATENT DOCUMENTS

| | | |
|---|---|---|
| CN | 102399188 A | 4/2012 |
| CN | 103007869 A | 4/2013 |

* cited by examiner

*Primary Examiner* — David Sorkin
(74) *Attorney, Agent, or Firm* — Mintz Levin Cohn Ferris Glovsky and Popeo, P.C.; Peter F. Corless; Steven M. Jensen

(57) ABSTRACT

A fluid mixing device includes a double pipe, a feed hopper, and a mixing chamber having a concave disc and a plurality of guide plateguide plates, wherein the double pipe has an inner pipe body, an outer pipe body, and a plurality of stoppers for forming a plurality of channel openings between the inner pipe body and the outer pipe body. The fluid flows through the double pipe and the feed hopper, and then lashes the concave disc in the mixing chamber to achieve a fast and uniform mixing effect.

11 Claims, 5 Drawing Sheets

FLUID MIXING DEVICE

CROSS-REFERENCES TO RELATED APPLICATIONS

This application claims under 35 U.S.C. §119(a) the benefit of Taiwanese Application No. 102223698, filed Dec. 16, 2013, the entire contents of which is incorporated herein by reference.

BACKGROUND OF THE INVENTION

1. Field of the Invention

The present invention is directed to a fluid mixing device. Specially, the present invention is directed to a fluid mixing device for optionally mixing three different fluids.

2. Description of Related Art

In the chemical reaction, the uniformity of mixing in fluids is an important factor for the completeness of the reaction. On the other hand, when two fluid phases are mixed, it is also desired to allow two fluid phases uniform or contact each other completely. U.S. Pat. No. 3,601,318 discloses an apparatus for mixing liquids comprising a pipe for flowing a process liquid. It can be observed along the direction of the flow that a bore of the pipe is narrowed to form a throat and a portion downstream of the throat is wider than the throat. Further, lots of nozzles are positioned around the periphery of the pipe and open into the pipe. The feed liquid can be mixed into the process liquid through these nozzles.

U.S. Pat. No. 4,285,367 discloses a device for mixing fluids comprising a first fluid feed tube whereas lots of channels are disposed around an outlet of the first fluid feed tube. The second fluid spouts toward the center to conduct the first mixing with the first fluid through these channels. The second mixing is conducted due to the fluid impact reflection in the concave disc positioned below the first fluid feed tube. However, although such technology may achieve a fast and uniform mixing effect, the vibration is more likely to happen because of the high second fluid spouting velocity and the huge impact against the dish. Moreover, when the second fluid is easy to condense or has high viscosity, the recourse is put off or the driving force is insufficient as a result of the pluuged channels, and then the difficulties of maintenance and cleanness works will increase.

Chinese Patent No. 102399188 discloses a method for preparing caprolactam by conducting the transposition reaction of cyclohexanone oxime in a hypergravity reactor. Compared with a conventional static mixer, it may have a better mixing efficiency and also consumes more energy.

Chinese Patent No. 103007869 discloses a three liquid phase material feeding nozzle comprising a first liquid feeding tube. The second flow spouts toward the center for mixing via a plurality of channel openings surrounding the periphery of the tube. Subsequently, the second flow flows along the original feeding direction, and be dispersed a ring type by the columnar stopper. Thereafter, the third flow spouts toward the center for mixing via a plurality of channel openings surrounding the periphery of the tube, and then conducts to mix the liquids again. However, the mixing efficiency for such mixing method still needs to be improved.

SUMMARY OF THE INVENTION

The present invention provides a fluid mixing device comprising a double pipe comprising an inner pipe body having a first inlet and an opposing first outlet, an outer pipe body surrounding the inner pipe body and having a second inlet and an opposing second outlet, and a plurality of stoppers disposed between the inner pipe body and the outer pipe body to form a plurality of channel openings between the inner pipe body and the outer pipe body; a feed hopper for housing the double pipe and having a funnel-shaped. channel, a third inlet and an opposing third outlet, wherein the third outlet is positioned at the bottom of the funnel-shaped channel and corresponding in position to the first outlet and the second outlet of the double pipe; and a mixing chamber disposed below the funnel-shaped channel and having a concave disc positioned below the third outlet, a plurality of guide plates surrounding the concave disc, wherein an included angle formed between a surface of each of the guide plates and the radial direction of the concave disc ranges from 0° to 75°.

The fluid mixing device of the present invention has three feeding manner such as inner layer, middle layer and outer layer. It makes the fluid split into two feeding streams, and can reduce a subjected impact for the concave disc to avoid vibrations via the multi-level fluid confluence and it does not reduce the mixing effects. In addition, the fluid mixing device of the present invention may optimally mix three different fluids, and meanwhile, improves the plugged channels caused by not smooth flow ,which is easy to condense or has high viscosity.

BRIEF DESCRIPTION OF THE DRAWINGS

FIG: 1 is a schematic depiction of the assembled fluid mixing device of the present invention.

DETAILED DESCRIPTION OF THE PREFERRED EMBODIMENTS

Figure 1:
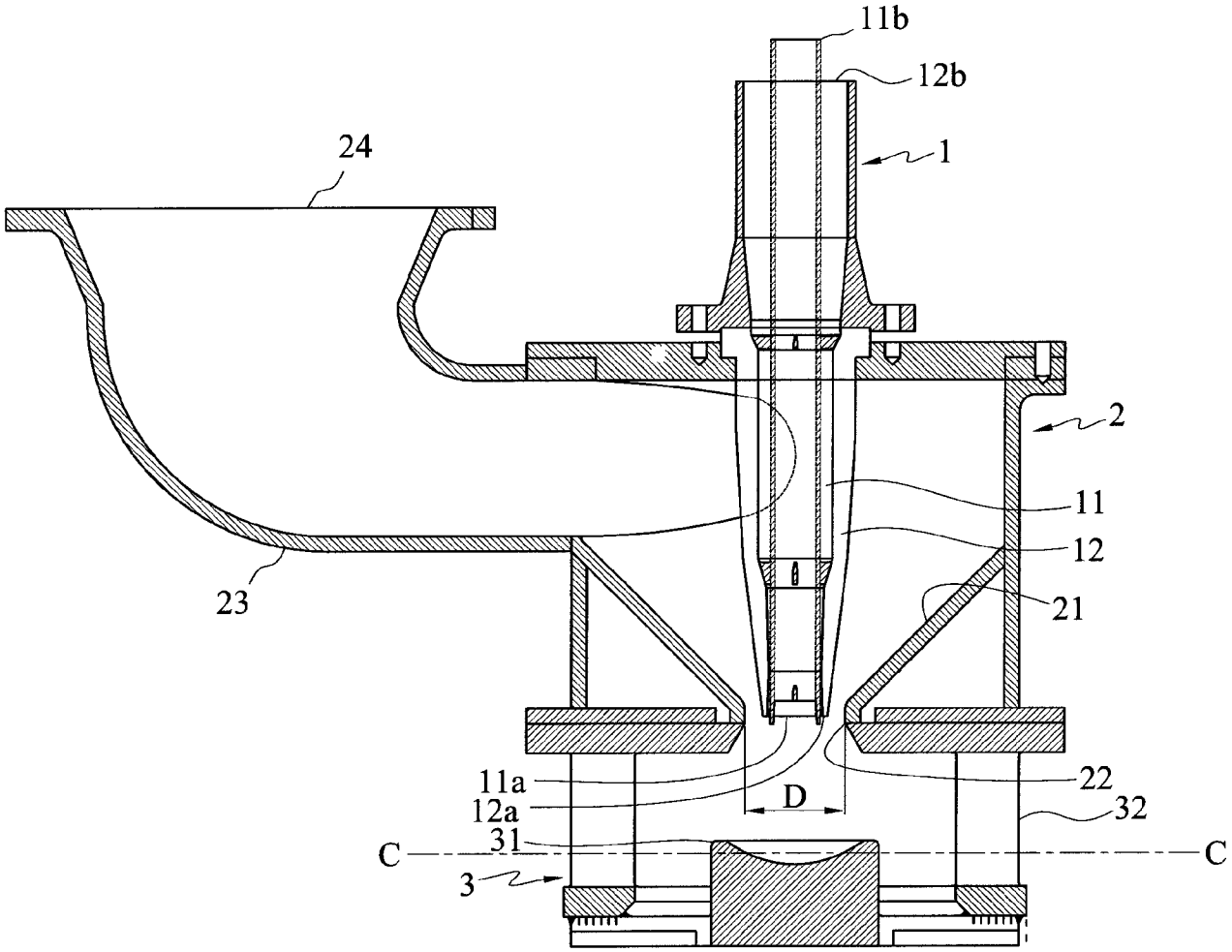

The following specific examples are used for illustrating the technical contents and the embodiments of the present invention. A person skilled in the art can easily conceive the advantages and effects of the present invention. The present invention can also be implemented or applied by different specific cases. The details of the present specification can also be based on different perspectives and applications in various modifications and changes without departing the spirit of the disclosure.

It should be noted that the structure, ratio, size, etc. shown in the drawings of the present specification are merely illustrative to realize and read for those of ordinarily skilled in the art and not intended to limit the scope of the present invention, and there is no substantial meaning in techniques. Various modifications and variations based on different viewpoints and applications can be made in the details of the specification without departing from the spirit of the present invention. Further, terms "upper", "lower", "front", "back", and "a/an" etc. are merely for illustrative purpose and should not be construed to limit the scope of the present invention.

As shown in FIG. 1, the fluid mixing device of the present invention comprises a double pipe 1, a feed hopper 2, and a mixing chamber 3. The double pipe 1 comprises an inner pipe body 11 and an outer pipe body 12. The inner pipe body 11 is a feed channel for the fluid and has a first outlet 11 a and a first inlet 11*b*. The outer pipe body 12 is also a feed channel for the fluid and has a second outlet 12*a* and a second inlet 12*b*. In one preferred embodiment, the outer pipe body 12 is a half-fusiform pipe body, for example, a cross sectional area or diameter of the second outlet 12*a*. of the outer pipe body 12 is smaller than those of the second inlet 12*b*.

Figure 2:
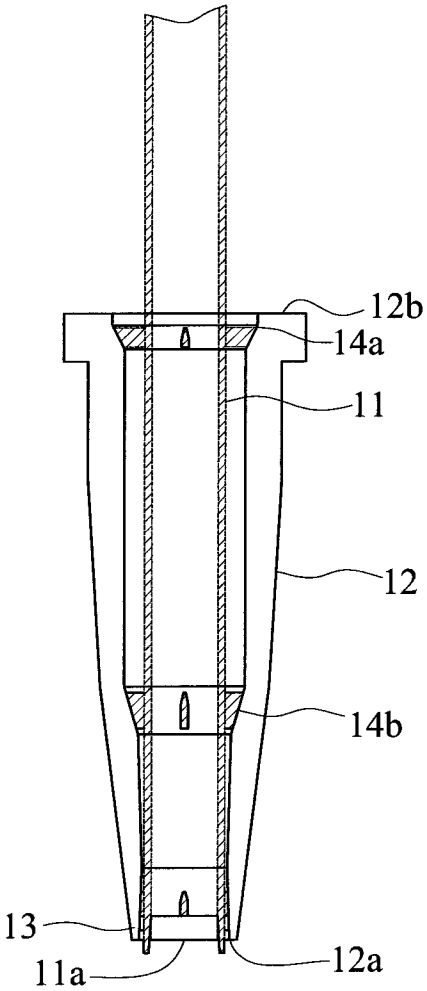
FIG. 2 is a partially enlarged schematic depiction of the double pipe of the present invention.
Figure 3:
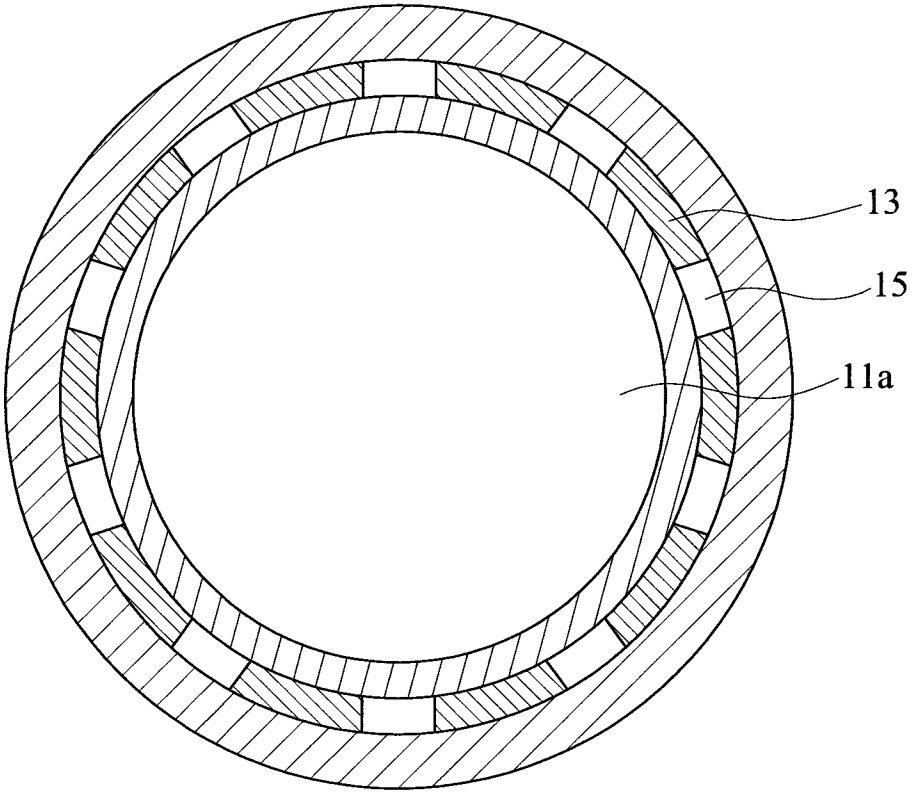
FIG. 3 is a cross-section schematic depiction of the double pipe with the stoppers in place according to FIG. 1.

Further referring to the partially enlarged schematic depiction of the double pipe 1 shown in FIG. 2 and FIG. 3, retaining rings 14*a*, 14*b*, and various stoppers 13 are disposed between the periphery of the outer wall of the inner pipe body 11 and the inner wall of the outer pipe body 12, The retaining rings 14*a*, 14*b* are above the stoppers 13, that is, the stopper 13 is between the retaining rings 14*a*, 14*b* and the second outlet 12*a*, preferably, at the second outlet 12*a*, for supporting and fixing the inner pipe body 11, and forming a plurality of channel openings 15 between the inner pipe body 11 and the outer pipe body 12 at the same time. In addition, the second outlet 12*a* is divided into a plurality of channel openings 15, so that the fluid flowing in the interval between the inner pipe body 11 and the outer pipe body 12 spouts out and is dispersed into multiple columnar fluids.

The number of the channel openings 15 divided by the stopper 13 can be any suitable quantity, such as 2 to 20, preferably 4 to 10. The width of the channel opening can be any suitable width, and the suggested width is more than 1 mm, preferably ranges from 2 to 6 mm. The suggested thickness is more than 5 mm, preferably ranges from 1 to 4 mm. The channel openings having the above width and thickness can reduce the risk of the plug.

The retaining rings 14*a*, 14*b* are optically used to support the inner pipe body 11 so that the inner pipe body 11 and the outer pipe body 12 can be kept at a fixed distance. The number of the retaining rings can be any suitable quantity, preferably at least 2, so as to help the stopper 13 supporting the inner pipe body 11.

Figure 4:
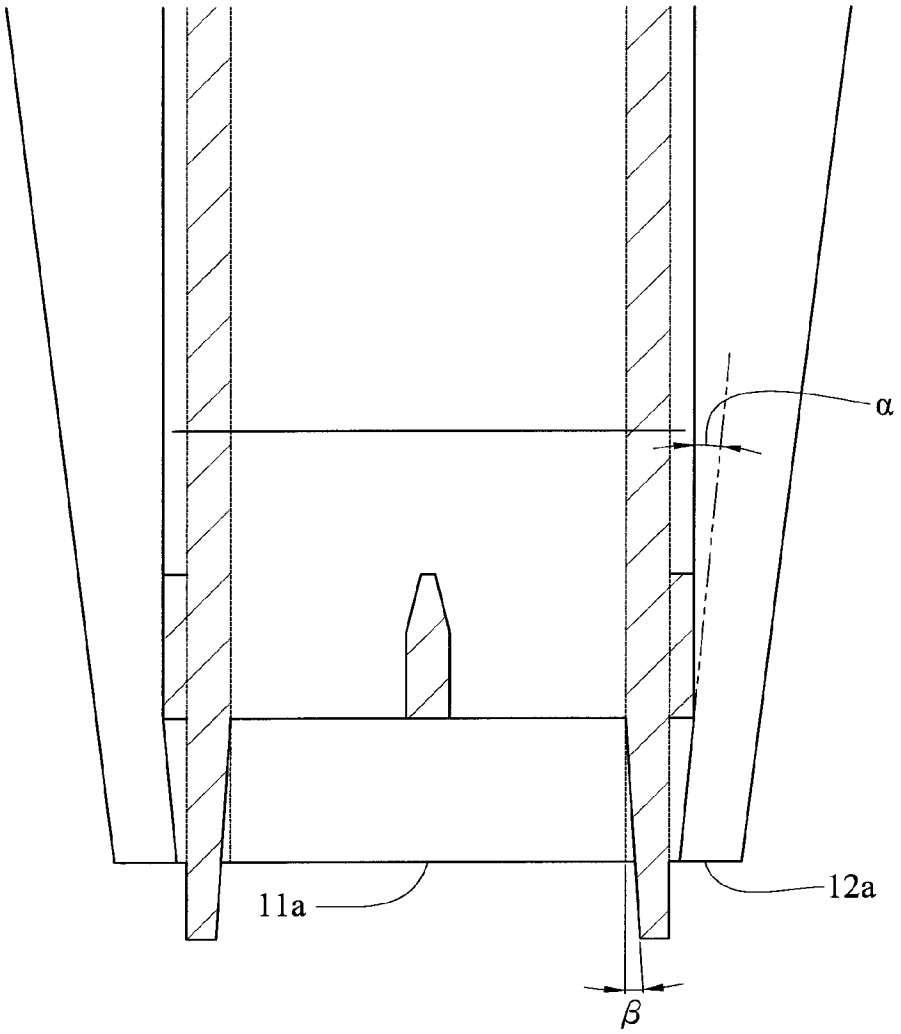
FIG. 4 is partially enlarged schematic depiction of the outlet of the double pipe of the present invention.

Moreover, as shown in FIG. 4, the preferred path, which the fluid spouts from the second outlet 12*a*, is slightly biased toward the center of the inner pipe body 11. For example, the inner wall of the outer pipe body 12 at the second outlet is slightly corrected to an inward adjusting angle $\alpha$ toward the inner pipe body 11, so that the inner wall is biased toward the center the inner pipe body 11. The angle $\alpha$ can be, for example, more than 0° to 45°, preferably 5° to 15°. In addition, the outlet at the inner wall of the first outlet of the inner pipe body 11 can also have a flare angle $\beta$ of 5° to 45°.

Further referring to FIG. 1, the feed hopper 2 has a funnel-shaped channel 21, whose diameter is decreased gradually from top to bottom. The bottom of the feed hopper 2 has a third outlet 22, The feeding can be accomplished by, for example, inclined inserting from the feed hopper 2, such as, inclinedly inserting into a feed tube 23 having the third inlet 24 along the tangent line of the inner wall of the feed hopper 2. When a fluid enters into the feed hopper 2, the funnel-shaped channel 21 can make the entered fluid to generate a cyclonic rotation along the shape of the funnel-shaped channel 21. Then, a fluid wall is formed when the fluid left from the third outlet 22.

Figure 5:
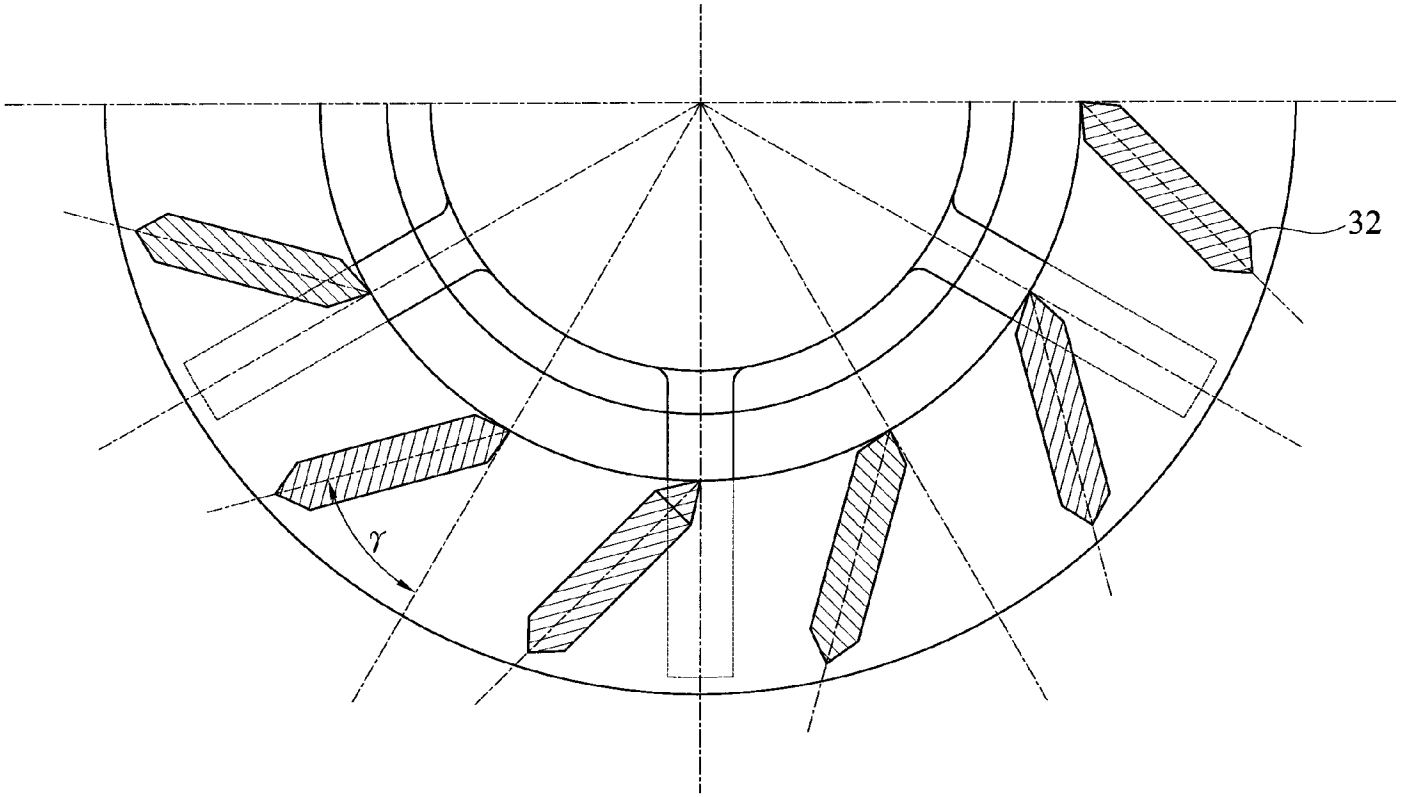
FIG. 5 is a cross-section schematic depiction of the section line c-c in FIG. 1.

Referring to FIG. 1 and FIG. 5, the mixing chamber 3 is connected to the bottom of the feed hopper 2. A concave disc 31 having an arc-shaped concave is just below the third outlet. The periphery of the concave disc 31 is surrounded by a plurality of guide plates 32. The guide plates 32 are connected with the feed hopper 2. The preferred included angle $\gamma$ between the surface of the guide plate and the radial direction of the concave disc is 0° to 75°, more preferably 30° to 60°. Such design is useful for quickly dispersing the mixing fluid after lashing the concave disc.

The size of each inlet and outlet of the pipe of the present invention can he designed based on the diameter of the third outlet. For example, if the diameter of the third outlet is set as D, the diameter of the second inlet of the double pipe is about 0.9 D to 1.5 D, preferably 1 D to 1.3 D; the diameter of the second outlet 12*a* is about 0.3 D to 0.9 D, preferably 0.4 D to 0.6 D; the diameter of the first inlet is 0.2 D to 0.8 D, preferably 0.3 D to 0.6 D.

In addition, the suitable diameter of the concave disc 31 positioned below the third outlet 22 is 0.6 D to 3 D. The suitable distance from the third outlet 22 to the center of the concave surface of the concave disc 31 is 0.2 D to 2 D.

Each inlet and outlet may have different fluid velocity. For example, the fluid velocity through the first outlet 11*a* is set as 5 to 20 m/s, preferably 8 to 11.4 m/s; the fluid velocity through the second outlet 12*a* is 5 to 20 m/s, preferably 8 to 12.41 m/s; the fluid velocity through the third outlet 22 is 5 to 20 m/s, preferably 8 to 11.55 m/s.

Meanwhile, each pipe may have different temperature. When a fluid with a high temperature is introduced to the inner pipe body, the plugged channels caused by the condensation of the fluid flowing in the interval between the pipes can be avoided. For example, if the solidifying point of the fluid flowing in the interval between the pipes is 90°, the temperature of the fluid flowing in the inner pipe body can be 100°.

The fluid mixing device can optically mix two or three fluids. When the different fluids are introduced to the outside or outside of the double pipe, respectively, the fluid of the interval is dispersed into multiple columnar fluids by the stoppers at the spouting port. Meanwhile, because of the structure design about the inward adjusting angle, the first mixing is generated at the place where another fluid spout from the inner pipe body is mixed with the fluid. Later, the first mixing fluid lashes the concave disc positioned at the bottom of the mixing chamber to provide a reflecting fluid. The reflecting fluid encounters the follow-up first mixing fluid to generate the second mixing. The third fluid (or one of above two fluids) flows down from the feed hopper along the hopper wall in a rotating manner and forms a circular fluid at the periphery of the disc. Subsequently, the third fluid encounters the dispersed fluid after lashing the disc to provide the third mixing. After that, all of fluids after lashing and mixing are radially dispersed from the guide plates. By this device, the various fluids can be mixed many times to achieve the effects that each fluid mix sufficiently and evenly so that the vibration is reduced and the lifespan of this device is increased.

Further, when this device is applied in the reaction, it can remove the reaction heat quickly. In addition, when the fluid with a high temperature is introduced to the inner pipe body, the plugged channel caused by the condensation of the fluid flowing in the interval between the inner pipe body and outer pipe body can he avoided.

Although the device of the present invention has three pipe layers, it can also mix only two fluids. When the device mixes two fluids, the second fluid can be split into two feeding streams, such as the first inlet and the third inlet. Such two feeding streams s can be the same fluid, such as the second fluid, so as to reduce the impact of the disc and the vibration.

The above-described descriptions of the detailed embodiments are only to illustrate the principle and efficacy of the present invention, and it is not to limit the present invention. it is possible for one person skilled in the art to modify the above embodiments without departing from the spirit and scope of the present invention. The scope of present invention, therefore, should be defined by the appended claims.

What is claimed is:

1. A fluid mixing device, comprising:

a double pipe comprising:

an inner pipe body having a first inlet and an opposing first outlet;

an outer pipe body surrounding the inner pipe body, and having a second inlet and an opposing second outlet; and a plurality of stoppers disposed between the inner pipe body and the outer pipe body to form a plurality of channels between the inner pipe body and the outer pipe body;

a feed hopper for housing the double pipe, having:

a funnel-shaped channel; and a third inlet and an opposing third outlet, wherein the third outlet is positioned at a bottom of the funnel-shaped channel, and corresponding in position to the first outlet and the second outlet of the double pipe; and a mixing chamber disposed below the funnel-shaped channel and having:

a concave disc positioned below the third outlet, a plurality of guide plates surrounding the concave disc, wherein an included angle formed between a surface of each of the guide plates and the radial direction of the concave disc ranges from 0° to 75°.

2. The fluid mixing device of claim 1 the outer pipe body is a half-fusiform pipe body.

3. The fluid mixing device of claim 1, wherein a cross-sectional area of the second outlet of the outer pipe body is smaller than that of the second inlet.

4. The fluid mixing device of claim 1, wherein the included angle formed between the surface of each of the guide plates and the radial direction of the concave disc ranges from 30° to 60°.

5. The fluid mixing device of claim 1, wherein a diameter of the first inlet of the inner pipe body is 1/5 to 4/5 of that of the third outlet of the feed hopper, a diameter of the second inlet of the outer pipe body is 9/10 to 1.5 times of that of the third outlet of the feed hopper, and a diameter of the second outlet of that the outer pipe body is 3/10 to 9/10 of that of the third outlet of the feed hopper.

6. The fluid mixing device of claim 1, wherein numbers of the channel of the double pipe are 2 to 20.

7. The fluid mixing device of claim 6, wherein a width of each of the channels ranges from 2 to 6 mm and a thickness of each of the channels ranges from 1 to 4 mm.

8. The fluid mixing device of claim 1, wherein a diameter of the concave disc is 0.6 to 3 times of that of the third outlet of the feed hopper, and a distance between the third outlet and the center of the concave disc is 0.2 to 2 times of the diameter of the third outlet.

9. The fluid mixing device of claim 1, further comprising a retaining ring disposed between the inner pipe body and the outer pipe body, and above the stopper and used for supporting and fixing a spacing between the inner pipe body and the outer pipe body.

10. The fluid mixing device of claim 1, wherein an inner wall of the first outlet of the inner pipe body has a flare angle toward the outer pipe body of 5° to 45°.

11. The fluid mixing device of claim 1, wherein an inner wall of the second outlet of the outer pipe body has an inward adjusting angle toward the inner pipe body of more than 5° to 45°.

* * * * *